United States Patent [19]

Hueschen et al.

[11] 4,132,916

[45] Jan. 2, 1979

[54] HIGH THERMAL EMITTANCE COATING FOR X-RAY TARGETS

[75] Inventors: Robert E. Hueschen, Hales Corners; Richard A. Jens, Milwaukee, both of Wis.

[73] Assignee: General Electric Company, Schenectady, N.Y.

[21] Appl. No.: 769,067

[22] Filed: Feb. 16, 1977

[51] Int. Cl.[2] ..... H01J 35/08

[52] U.S. Cl. ..... 313/330; 252/520; 165/133; 427/34; 427/423

[58] Field of Search ..... 313/330, 60; 252/520; 165/133; 427/34, 423

[56] References Cited

U.S. PATENT DOCUMENTS

| | | | |
|---|---|---|---|
| 3,919,124 | 11/1975 | Friedel et al. | 313/330 |
| 3,951,873 | 4/1976 | Kikuchi et al. | 252/520 |
| 3,993,923 | 11/1976 | Magendans et al. | 313/330 |
| 4,029,828 | 6/1977 | Bildstein et al. | 313/330 |

FOREIGN PATENT DOCUMENTS

| | | | |
|---|---|---|---|
| 7602280 | 9/1976 | Netherlands | 313/330 |

*Primary Examiner*—Saxfield Chatmon, Jr.
*Attorney, Agent, or Firm*—Ralph G. Hohenfeldt

[57] ABSTRACT

A high thermal emittance coating for an X-ray tube anode target comprises a high melting point oxide or a mixture of such oxides added to titanium dioxide and another oxide selected from the group consisting of calcium oxide and yttrium oxide.

28 Claims, 2 Drawing Figures

Fig. 1
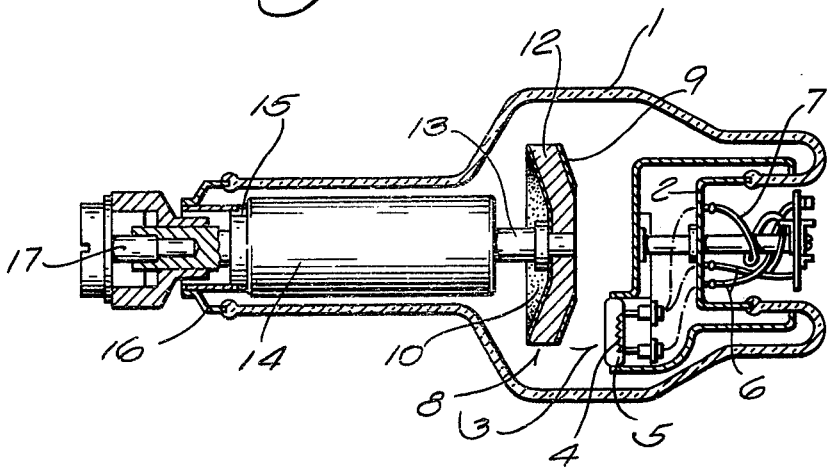
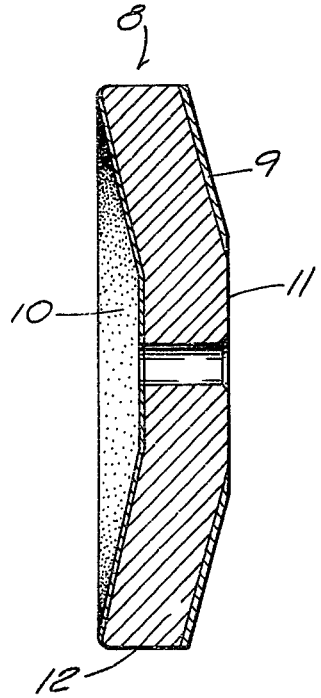
Fig. 2

HIGH THERMAL EMITTANCE COATING FOR X-RAY TARGETS

BACKGROUND OF THE INVENTION

This invention relates to a coating for improving the thermal emittance of an x-ray tube anode.

It is well known that of the total energy involved in an electron beam striking an x-ray target only about one percent of the energy is converted into x-radiation while about ninety-nine percent is converted into heat. For rotating anode x-ray tubes, this thermal energy must be dissipated primarily by radiation from the target to a surrounding fluid cooled casing. Only a small amount of heat may be removed by conduction since removal of substantial heat through the rotor would increase bearing temperatures. Typically, bearing temperatures must be limited to about 500° C. or the bearing alloy will soften and become inoperative.

Some diagnostic x-ray techniques now in common use apply high voltage and high electron beam current to the x-ray tube for such duration as to risk exceeding the heat storage capacity of the target and anode structure. Cine techniques, for example, are often terminated short of the desired duration because to complete an exposure sequence without allowing the target to cool would destroy it. Thus, the heat radiating capability of the target becomes a limiting factor in x-ray tube ratings. For a typical rotating anode x-ray tube, the temperature of the focal spot track of the target may be about 3100° C. and the bulk temperature of the target may approach 1350° C. for many diagnostic techniques. Convection cooling of a high vacuum tube is not possible so a tremendous amount of heat must be radiated through the glass envelope and, hence, to the oil circulating in the tube casing.

It is well known that thermal emittance of x-ray tube anode targets can be enhanced to some extent by roughening the target's surface outside of the focal spot track or by coating such surface with various compounds. An ideal coating would be one that has an emittance of 1.0 which is the theoretical maximum emittance of a black body. A variety of thermal emittance enhancing coatings have been used including tantalum carbide and various oxide mixtures such as oxides of aluminum, calcium and titanium. The coating materials are usually sprayed onto the refractory metal target body and fired at a high temperature in a vacuum or, in other words, at very low pressure to effect adhesion with the surface of the target. Some of these target coating materials have reasonably high emittance when they are applied but after they are fired at temperatures necessary to effect adhesion they undergo a substantial drop in emittance. It is not unusual for a material that has an intrinsic emittance of as high as 0.85 to drop down to 0.70 after processing.

Major disadvantages of target coating materials that are known to be in use up to this time are that their thermal emittance is too far below the theoretical limit of 1.0 for a black body and the coatings consist of particles which can flake off of the target when the x-ray tube is in use. These particles become positively charged during tube operation and are attracted to the electrically negative cathode. The particles cause high electric intensity fields on the cathode which reduces the ability of the tube to hold off the 150 peak kilovolts between anode and cathode which are required for tube operation.

SUMMARY OF THE INVENTION

An object of the present invention is to mitigate the above mentioned deficiencies in prior art emittance coatings by providing a surface layer or coating which, under operating conditions in the x-ray tube, has high thermal emittance, is fused rather than particulate and is bonded tightly to the target body so as to resist flaking off.

Another object is to provide a coating which can be raised to a sufficiently high temperature in a vacuum for its components to fuse into a dark, smooth, dense, thin homogeneous layer which will remain stable at temperatures over 1350° C. and stable in a vacuum at $10^{-7}$ Torr or less which exists in an x-ray tube.

Still another object is to provide a new coating composition which has high thermal emittance and good adhesion properties which make it suitable for some applications even though it is not processed at temperatures which would cause it to fuse.

More specifically, the invention involves coating an anode with a mixture of high melting point oxides selected from the group consisting of zirconium dioxide ($ZrO_2$), hafnium oxide (HfO), magnesium oxide (MgO), strontium oxide (SrO), cerium dioxide ($CeO_2$) and lanthanum oxide ($La_2O_3$) or mixtures thereof stabilized with calcium oxide (CaO) or yttrium oxide ($Y_2O_3$) and mixed with titanium dioxide ($TiO_2$) in the correct proportion and firing the coated anode in a vacuum to produce a dense, fused, high thermal emittance coating for increasing anode heat storage capacity and cooling rate.

How the foregoing objects and other more specific objects of the invention are achieved will appear in the ensuing more detailed description of the composition and methodology which will now be set forth in reference to the drawing.

DESCRIPTION OF THE DRAWING

FIG. 1 is a typical rotating anode x-ray tube, shown in section, in which the new target coating material may be used; and FIG. 2 is a cross section of an x-ray anode target body.

DESCRIPTION OF A PREFERRED EMBODIMENT

In FIG. 1, the illustrative x-ray tube comprises a glass envelope 1 which has a cathode support 2 sealed into one end. A cathode structure 3 comprising an electron emissive filament 4 and a focusing cup 5 is mounted to support 2. There are a pair of conductors 6 for supplying heating current to the filament and another conductor 7 for maintaining the cathode at ground or negative potential relative to the target of the tube.

The anode or target on which the electron beam from cathode 3 impinges to produce x-radiation is generally designated by the reference numeral 8. Target 8 will usually be made of a refractory metal such as molybdenum or tungsten or alloys thereof but in tubes having the highest rating the target is usually mostly tungsten. A surface layer on which the electron beam impinges while the target is rotating to produce x-rays is marked 9 and is shown in cross section in FIGS. 1 and 2. Surface layer 9 is commonly composed of tungsten-rhenium alloy for well-known reasons.

The rear surface 10 of target 8 is concave in this example and is one of the surfaces on which the new high thermal emittance coating may be applied. The coating may also be applied to areas of the target outside of the focal spot track such as the front surface 11 and the peripheral surface 12 of the target.

In FIG. 1 the target 8 is fixed on a shaft 13 which extends from a rotor 14. The rotor is journaled on an internal bearing support 15 which is, in turn, supported from a ferrule 16 that is sealed into the end of the glass tube envelope 1. The stator coils for driving rotor 14 as an induction motor are omitted from the drawing. High voltage is supplied to the anode structure and target 8 by a supply line, not shown, coupled with a connector 17.

As is well known, rotary anode x-ray tubes are usually enclosed within a casing, not shown, which has spaced apart walls between which oil is circulated to carry away the heat that is radiated from rotating target 8. As indicated above, the bulk temperature of the target often reaches 1350° C. during tube operation and most of this heat has to be dissipated by radiation through the vacuum within tube envelope 1 to the oil in the tube casing which may be passed through a heat exchanger, not shown. It is common to coat the rotor 14 with a textured material such as titanium dioxide to increase thermal emittance and thereby prevent the bearings which support the rotor from becoming overheated. If the heat storage capacity of the target 8 is not great enough or if its cooling rate is low, duty cycles must be shortened which means that the tube must be kept deenergized until the target reaches a safe temperature. This often extends the time required for an x-ray diagnostic sequence. Hence, it is important that the emittance of the target surfaces be maximized.

$TiO_2$ is a typical prior art coating material for the rotor 14. It has a thermal emittance value of about 0.85 and is suitable for parts such as the rotor 14 which, if the target 8 emits heat sufficiently well, will operate at a safe temperature of 500° C. or below. Pure $TiO_2$, however, is not suitable for coating targets in high power x-ray tubes because it would deteriorate at temperatures attained by the target. It cannot be raised to fusion temperature in a vacuum without degradation.

In accordance with the invention, new high emittance coatings are composed of $TiO_2$ added to any of the high melting point oxide materials selected from the group consisting of $ZrO_2$, HfO, MgO, $CeO_2$, $La_2O_3$ and SrO and mixtures thereof with the further addition of a stabilizer selected from the group of CaO and $Y_2O_3$.

In a case where CaO is chosen as the stabilizer, it should be present in the amount of 4% to 5% by weight. $TiO_2$ should be present in the amount of 2.5% up to 20% by weight. All of the other oxide materials, that is, $ZrO_2$, HfO, MgO, $CeO_2$, $La_2O_3$ and SrO taken singly or in combination should make up the remainder of 75% to 93.5% by weight. If the amount of oxide material is changed within the specified range of 75% to 93.5%, the amount of the $TiO_2$ should be adjusted to compensate provided $TiO_2$ remains within the range of 2.5% up to 20%.

In a case where $Y_2O_3$ is chosen as the stabilizer, it should be present in an amount of 5% to 10% by weight. $TiO_2$ should be used in the amount of 2.5% up to 20% by weight. All of the other oxide materials in the group of $ZrO_2$, HfO, MgO, $CeO_2$, $La_2O_3$ and SrO taken singly or in combination should make up the remainder of 70% to 92.5% by weight in this case. Again, variations in the amounts of oxide materials should be compensated by adjusting the amount of $TiO_2$ provided it remains in the range of 2.5% up to 20%.

A thermal emittance coating, within the scope of those stated broadly above, which is considered preferred because of low cost and good availability of materials, is one that is composed of 75% to 93.5% by weight of $ZrO_2$ as the oxide material to which is added 4% to 5% by weight of CaO and 2.5% up to 20% of $TiO_2$.

By way of example and not limitation, some specific oxide coating concentrations which have been demonstrated to successfully produce a black, fused coating with thermal emittance values of 0.92 to 0.94 are the following wherein the compounds are all given in weight percent:

1. 76% $ZrO_2$ - 4% CaO - 20% $TiO_2$
2. 80.75% $ZrO_2$ - 4.25% CaO - 15% $TiO_2$
3. 85.5% $ZrO_2$ - 4.5% CaO - 10% $TiO_2$
4. 87.88% $ZrO_2$ - 4.62% CaO - 7.5% $TiO_2$

The white powdered mixtures comprised of $TiO_2$, the other oxide materials and CaO or $Y_2O_3$ stabilizer or both are applied as a thin layer on any surface of the target which is outside of the focal track. The target is then fired at temperatures which will be given below in a high vacuum ambient so as to produce a dense, thin, smooth, homogeneous high emittance coating.

One desirable way of depositing the oxide mixture on the target is to spray it on with a plasma gun in an air ambient. The plasma gun is a well-known device in which an electric arc is formed between a tungsten electrode and a surrounding copper electrode. The oxide materials are conveyed through the arc in a stream of argon gas. While passing through the plasma created by the recombination of the ionized gas atoms, the particles are melted and projected toward the target surface by the gas stream. The molten particles impinge on the surface being coated which results in the coating having a textured rather than a fused glossy appearance at this time.

The coating may be applied by other methods. The oxides may be entrained in a suitable binder or other volatile fluid vehicle and sprayed or painted on the target surface. The oxides may also be vacuum sputtered in an inert gas or the metals which comprise the oxides may be vacuum sputtered in a partial pressure of oxygen to produce the oxide coatings.

In the case of plasma arc spraying, the $TiO_2$ which is originally white is partially stripped of oxygen since the plasma arc operates at very high temperature. At this stage of the process, the white $TiO_2$ in the mixture is converted to blue-black. Depending upon the amount of $TiO_2$ in the mixture, the coating, after spraying, has a thermal emittance in the range of about 0.6 to 0.85 and, upon inspection with the naked eye or with very little magnification, the coating appears textured and particulate. Under these circumstances, diffusion and bonding with the target's surface metal is not maximized as yet. In this state, however, the new coating can be used to good advantage in a relatively low operating temperature application such as on the anode rotor 14.

After the coating material is deposited uniformly by any of the suggested methods, the next step in the process is critical in optimizing the thermal emittance and in producing a smooth fused coating in which no powder particles can be discerned. Thus, the next step is to fire the coated x-ray target in a vacuum, actually at low pressure of $10^{-5}$ Torr or less, to produce a fused black coating in which the $TiO_2$ is further deficient in oxygen. The firing temperature should be at least 1650° C. and should not exceed 1900° C. The best practice is to keep the target in the heat only long enough for its bulk temperature to reach 1650° C. which typically might take 15 minutes. If kept in the heat too long, the fused coating may run or flow to areas not intended to be coated.

The oxide composition, after fusing in vacuum, becomes a coating which is stable in the high vacuum of an x-ray tube at least up to 1650° C., which is above any expected temperature for the target outside of the focal track. Coatings formed in accordance with this method, have consistently exhibited thermal emittances of 0.92 to 0.94.

It will be evident to those skilled in the art that the target 8 could not be fired when attached to rotor 14 since the copper and steel portions of the rotor would melt at 1083° C. and 1450° C., respectively.

The oxides $ZrO_2$, HfO, MgO, $CeO_2$, SrO and $La_2O_3$ when stabilized with either CaO or $Y_2O_3$ desirably fuse and melt at temperatures above the operating temperature of the bulk of the x-ray tube target and the resultant oxide mixture is capable of remaining stable in a $10^{-10}$ Torr vacuum existing in an x-ray tube envelope in a state deficient in oxygen while remaining black and in a high thermal emittance state in excess of 0.90.

The concentration of the oxide materials besides the stabilizers and $TiO_2$ is made greater than that of $TiO_2$ because they are high melting point materials melting generally above 2700° C. and $TiO_2$ melts at 1800° C. $TiO_2$ should always be 20% or less by weight. The CaO in a relatively low concentration of about 5%, melts at 2600° C. and prevents the undesirable monoclinic phase of $ZrO_2$ and the other oxide materials from forming at low temperatures. $TiO_2$ alone, or in the absence of the other oxides used herein, will dissociate in vacuum at a temperature of about 1200° C. which is substantially below the required operating temperatures for the target. It is known that the change to the monoclinic phase of $ZrO_2$ or HfO, for example, is characterized by a change in thermal expansion in which case, as has occurred in many prior art coatings of other compositions, the coating would tend to flake off of the target due to the differential expansion between the target body and the coating.

As indicated earlier, $Y_2O_3$ may also be used to stabilize the oxides of Zr, Hf, Mg, Ce, Sr and La in place of CaO. $Y_2O_3$ melts at 2400° C. As mentioned before, if $Y_2O_3$ is used to stabilize the selected oxide or oxides of Zr, Hf, Mg, Ce, Sr and La, a 5% to 10% by weight addition should be used which requires a small reduction in the enumerated oxides in the large group and $TiO_2$ concentrations. In the evaluation of oxide materials enumerated above which were stabilized with either or both CaO and $Y_2O_3$, it was shown that it is the $TiO_2$ which is deficient in oxygen that produces the black coating since both oxide specimens which were stabilized with CaO and $Y_2O_3$ or both and which were sprayed and vacuum fired in the absence of $TiO_2$ could not be fused and both resulted in yellow-gray coatings having thermal emittance values of about 0.6 as compared with emittances of over 0.9 when $TiO_2$ in the concentrations given above was present.

It is also within the scope of the uses contemplated for the new above enumerated stabilizer oxides and $TiO_2$ compositions to fire the plasma arc sprayed coating material in a vacuum at a temperature below 1600° C. for certain applications where an unfused coating with emittance values slightly under 0.9 are satisfactory. Firing at a little below 1600° C. still produces the black thermal emittance coating but it is particulate.

Firing at 1650° C. or higher as mentioned earlier, results in the smooth, homogeneous, dense and thin coating which are desirable properties for x-ray tube targets. Thin coatings are advantageous in that there is only a small thermal gradient through them which means that the coating and target body tend to expand and contract similarly rather than differentially. High density improves heat transmission through the coating. It is also worthy to note that photomicrographs of a cross section of a target surface that has been coated and raised to the temperature of fusion show that the coating is ceramic in nature and that it has flowed into any pores on the target surface to effect a good bond therewith. There appears to be no stratification nor discrete layer formed at the interface of the coating and the target body.

To enable those practicing the x-ray tube arts to evaluate the effectiveness of the new high emittance coatings described herein, similar targets were coated with a standard tantalum carbide and with the new fused compositions given above, respectively. The TaC coated target was maintained at 1120° C. by continuous application of 70 milliamperes at 40 peak kilovolts. The target with the new high emittance coating required much higher energy input of 80 milliamperes at 44 peak kilovolts to maintain it at 1120° C. Using the method of measuring heat units in a target which is most generally accepted by the industry, it was determined that the new coating produced a 26% gain in heat dissipation over the TaC coated target due only to the change in thermal emittance coating.

The scope of the invention is to be determined by construing the claims which follow.

We claim:

1. An x-ray tube anode comprised of a body having a surface region for being impinged by electrons to produce x-radiation and a coating distinct from said region for enhancing the thermal emittance of said body, said coating comprising:

the product resulting from heating at a pressure of $10^{-5}$ Torr or lower and at a temperature in the range of 1650° C. to 1900° C. a mixture comprising about 2.5% up to about 20% by weight of $TiO_2$, at least one oxide, totalling in the range of 70% to 93.5% by weight, selected from a first group consisting of $ZrO_2$, HfO, MgO, $CeO_2$, $La_2O_3$ and SrO, and at least one oxide for stabilizing the oxide selected from first group and being selected from a second group consisting of CaO and $Y_2O_3$, the amount of oxide from said second group making up the difference between 100 weight percent and the sum of the percentages of $TiO_2$ and the oxide or oxides from said first group.

2. The anode as in claim 1 wherein the oxide selected from said first group is in the range of 75% to 93.5% by weight and the selection from said second group is substantially CaO in the amount of 4% to 5% by weight.

3. The anode as in claim 1 wherein the total amount of oxide selected from said first group is in the range of 70% to 92.5% by weight and the selection from said second group is substantially $Y_2O_3$ in the amount of 5% to 10% by weight.

4. An x-ray tube anode comprised of a body having a surface region for being impinged by electrons to produce x-radiation and a coating distinct from said region for enhancing the thermal emittance of said body, said coating comprising:

the product resulting from heating at a pressure of $10^{-5}$ Torr or lower and at a temperature in the range of 1650° C. to 1900° C. a mixture comprising no less than 2.5% up to 20% by weight of $TiO_2$, at least one oxide in the total amount of 75% to 93.5% by weight selected from the group consisting of $ZrO_2$, HfO, MgO, $CeO_2$, $La_2O_2$ and SrO, and CaO in the amount of 4% to 5% by weight.

5. An x-ray tube anode comprised of a body having a surface region for being impinged by electrons to produce x-radiation and a coating distinct from said region for enhancing the thermal emittance of said body, said coating comprising:

the product resulting from heating at a pressure of $10^{-5}$ Torr or lower and at a temperature in the range of 1650° C. to 1900° C. a mixture comprising no less than 2.5% up to 20% by weight of $TiO_2$, at least one oxide in the total amount of 70% to 92.5% by weight selected from the group consisting of $ZrO_2$, HfO, MgO, $CeO_2$, $La_2O_3$ and SrO, and $Y_2O_3$ in the amount of 5% to 10% by weight.

6. An x-ray tube anode comprised of a body having a surface region for being impinged by electrons to produce x-radiation and a surface layer distinct from said region for enhancing thermal emittance of said body, said layer comprising:

the product resulting from heating at a pressure of $10^{-5}$ Torr or lower and at a temperature in the range of 1650° C. to 1900° C., a mixture comprised of 2.5% up to 20% by weight of $TiO_2$, 5% to 10% by weight of $Y_2O_3$and the remainder of at least one oxide selected from the group consisting of $ZrO_2$ and HfO.

7. A coating for enhancing thermal emittance of an article, said coating comprising:

the substantially black, textured and unfused product which is bonded to said article and results from spraying onto said article with a plasma gun a mixture comprised of about 2.5% by weight up to 20% by weight of $TiO_2$, 4% to 5% by weight of CaO and the remainder of $ZrO_2$.

8. A coating for enhancing thermal emittance of an article, said coating comprising:

the substantially black, textured and unfused product which is bonded to said article and results from spraying onto said article with a plasma gun a mixture comprised of about 2.5% by weight up to 20% by weight of $TiO_2$, 5% to 10% by weight of $Y_2O_3$ and the remainder of $ZrO_2$.

9. An x-ray tube anode comprised of a body having a surface region for being impinged by electrons to produce x-radiation and a surface layer distinct from said region for enhancing the thermal emittance of said body, said layer comprising:

the product resulting from heating at a pressure of $10^{-5}$ Torr or lower and at a temperature in the range of 1650° C. to 1900° C. a mixture comprised of about 2.5% up to 20% by weight of $TiO_2$, 4% to 5% by weight of CaO and the remainder of $ZrO_2$.

10. An anode as in claim 9 wherein the amount of $ZrO_2$ is 75% to 93.5% by weight and the amount of $TiO_2$ is adjusted proportionally to the amount of $ZrO_2$ so that the CaO is maintained at said 4% to 5% by weight.

11. An anode as in claim 9 wherein said mixture is comprised, in terms of weight percentages, of about 76% $ZrO_2$, 4% CaO and 20% $TiO_2$.

12. An anode as in claim 9 wherein said mixture is comprised, in terms of weight percentages, of about 80.75% $ZrO_2$, 4.25% CaO and 15% $TiO_2$.

13. An anode as in claim 9 wherein said mixture is comprised, in terms of weight percentages, of about 85.5% $ZrO_2$, 4.5% CaO and 10% $TiO_2$.

14. An anode as in claim 9 wherein said mixture is comprised, in terms of weight percentages, of about 87.88% $ZrO_2$, 4.62% CaO and 7.5% $TiO_2$.

15. An anode for an x-ray tube having a high thermal emittance coating on selected portions thereof, said coating comprising:

the product resulting from depositing on said anode a mixture of fine particles, said mixture comprising 2.5% up to about 20% by weight of $TiO_2$, 70% to 93.5% by weight of $ZrO_2$ and the balance being a stabilizer for $ZrO_2$ having the property of substantially preventing the monoclinic phase of $ZrO_2$ from forming when said coating is heated to a predetermined temperature at which said monoclinic phase would otherwise form, and heating said anode to above said predetermined temperature and to a temperature of at least 1650° C. and no higher than 1900° C. at a pressure of $10^{-5}$ Torr or lower to cause said particles to fuse into a non-particulate smooth substantially black coating.

16. The anode as in claim 15 wherein said stabilizer is CaO present in the amount of 4% to 5% by weight and said $ZrO_2$ is present in the amount of 75% to 93.5% by weight.

17. The anode as in claim 15 wherein said stabilizer is $Y_2O_3$ present in the amount of 5% to 10% by weight and said $ZrO_2$ is present in the amount of 70% to 92.5% by weight.

18. A method of producing a high thermal emittance coating on an anode for an X-ray tube, said method including the steps of:

depositing on selected surface regions of said anode a mixture of fine particles of $ZrO_2$ in the amount of 75% to 93.5% by weight, $TiO_2$ in the amount of 2.5% up to 20% by weight, and CaO in the amount of 4% to 5% by weight, and heating said anode at a pressure of $10^{-5}$ Torr or lower and at a sufficiently high temperature and for sufficient time to cause said particles to fuse into a non-particulate smooth substantially black coating.

19. The method as in claim 18 wherein said temperature is at least 1650° C. and no higher than 1900° C.

20. The method as in claim 18 wherein said time is at least sufficient for said anode to reach 1650° C.

21. A method of producing a high thermal emittance coating on an X-ray tube anode, said method including the steps of:

depositing on selected surface regions of said anode a mixture of fine particles of $ZrO_2$ in the amount of 70% to 9.25% by weight, $TiO_2$ in the amount of 2.5% up to 20% by weight, and $Y_2O_3$ in the amount of 5% to 10% by weight, and heating said anode at a pressure of $10^{-5}$ Torr or lower and at sufficiently high temperature and for sufficient time to cause said particles to fuse into a non-particulate smooth substantially black coating.

22. The method as in claim 21 wherein said temperature is at least 1650° C. and no higher than 1900° C.

23. The method as in claim 21 wherein said time is at least sufficient for said anode to reach 1650° C.

24. A method of producing a high thermal emittance coating on an x-ray tube anode, said method including the steps of:

depositing on selected surface regions of said anode a mixture of fine particles of $ZrO_2$ in the amount of 70% to 93.5% by weight, $TiO_2$ in the amount of 2.5% up to 20% by weight, and a stabilizer selected from the groups consisting of $Y_2O_3$ and CaO having the property of substantially preventing the monoclinic phase of $ZrO_2$ from forming when said $ZrO_2$ is at a predetermined high temperature said stabilizer being present in the amount of 4% to 10% by weight with variations in the amount of stabilizer being compensated solely by adjusting the amount of $ZrO_2$, and heating said anode at a pressure of $10^{-5}$ Torr or lower to a temperature of at least 1650° C. and no higher than 1900° C. for sufficient time to cause said particles to fuse into a non-particulate smooth substantially black coating.

25. The method as in claim 24 wherein said stabilizer is CaO present in the amount of 4% to 5% by weight and said $ZrO_2$ is present in the amount of 75% to 93.5% by weight.

26. The method as in claim 25 wherein said stabilizer is $Y_2O_3$ present in the amount of 5% to 10% by weight and said $ZrO_2$ is present in the amount of 70% to 92.5% by weight.

27. The method as in claim 24 wherein said temperature to which said anode is heated is at least 1650° C. when CaO is used and at least 1700° C. when $Y_2O_3$ is used.

28. The method as in claim 24 wherein said time is at least sufficient for said anode to reach a temperature of 1650° C. when CaO is used and to reach 1700° C. when $Y_2O_3$ is used.

* * * * *